US008641540B2

(12) United States Patent
Feuer et al.

(10) Patent No.: US 8,641,540 B2
(45) Date of Patent: Feb. 4, 2014

(54) INVERTED SIMULATION ATTRACTION

(76) Inventors: Roland Feuer, Glendale, CA (US); Matthew Sellers, Rancho Cucamonga, CA (US)

( * ) Notice: Subject to any disclaimer, the term of this patent is extended or adjusted under 35 U.S.C. 154(b) by 247 days.

(21) Appl. No.: 13/182,265

(22) Filed: Jul. 13, 2011

(65) Prior Publication Data

US 2013/0017893 A1 Jan. 17, 2013

(51) Int. Cl.
*A63G 31/06* (2006.01)
*A63G 31/16* (2006.01)

(52) U.S. Cl.
USPC ..... 472/43; 472/59; 472/130; 434/55

(58) Field of Classification Search
USPC ..... 472/43, 55, 59–61, 130; 434/29, 55, 58; 104/83, 85, 154
See application file for complete search history.

(56) References Cited

U.S. PATENT DOCUMENTS

| | | | | |
|---|---|---|---|---|
| 3,554,130 | A | 1/1971 | Broggie | |
| 4,879,849 | A | 11/1989 | Hollingsworth, III | |
| 5,022,708 | A | 6/1991 | Nordella | |
| 5,060,932 | A | 10/1991 | Yamaguchi | |
| 5,192,247 | A | 3/1993 | Barr | |
| 5,199,875 | A | 4/1993 | Trumbull | |
| 5,366,375 | A | 11/1994 | Sarnicola | |
| 5,403,238 | A | 4/1995 | Baxter | |
| 5,473,990 | A | 12/1995 | Anderson | |
| 5,527,221 | A | 6/1996 | Brown | |
| 5,551,920 | A | 9/1996 | Ogden | |
| 5,556,340 | A | 9/1996 | Bohn | |
| 5,558,582 | A | 9/1996 | Swensen | |
| 5,583,844 | A | 12/1996 | Wolf | |
| 5,623,878 | A | 4/1997 | Baxter | |
| 5,669,821 | A | 9/1997 | Prather | |
| 5,711,670 | A | 1/1998 | Barr | |
| 5,857,917 | A | 1/1999 | Francis | |
| 6,007,338 | A | 12/1999 | DiNunzio | |
| 6,095,926 | A | 8/2000 | Hettema | |
| 6,113,500 | A | 9/2000 | Francis | |
| 6,462,769 | B1 | 10/2002 | Trowbridge | |
| 6,533,670 | B1 | 3/2003 | Drobnis | |
| 6,592,374 | B1 | 7/2003 | Kim | |
| 6,902,488 | B2 | 6/2005 | Hashimoto | |
| 7,033,177 | B2 | 4/2006 | Kim | |
| 7,484,460 | B2 | 2/2009 | Blum | |
| 7,691,002 | B2 | 4/2010 | Casey | |
| 7,967,688 | B2 * | 6/2011 | Lai et al. | 472/43 |
| 2003/0224333 | A1 * | 12/2003 | Vastvedt | 434/29 |

* cited by examiner

*Primary Examiner* — Kien Nguyen
(74) *Attorney, Agent, or Firm* — Shenkman & Hughes; Kevin Shenkman

(57) ABSTRACT

A system for patron movement and entertainment comprising a track, and at least one vehicle engaged with and positioned below the track, capable of carrying at least one patron in a passenger portion and moving along the track. Each vehicle preferably includes a motion base between the track and the passenger portion, and a turntable between the track and the motion base for rotating the passenger portion in the yaw direction, and particularly for directing the patron's viewpoint toward desired show elements.

23 Claims, 4 Drawing Sheets

(Self-Propel Drive)

(SP Drive)

(CLV Drive)

INVERTED SIMULATION ATTRACTION

BACKGROUND OF THE INVENTION

1. Field of the Invention

The present invention relates generally to the field of amusement rides wherein patrons seated in cars are moved along a track, the cars are suspended from the track, and the car is pointed in various directions to view specific portions of the attraction. Optionally, a motion base positioned between the car and the track also allows for the simulation of movement, for example, the simulation of flight in various directions.

2. Prior Art

Amusement park rides and exhibit presentation systems employing cars, trams, or other means for moving patrons through the ride or exhibit have developed significantly over the past twenty years. Developers of amusement park rides have led the way in this field, exploring ways to enhance the experience of patrons in so called "dark rides"—rides in which patrons are physically taken through a story that is presented to the patrons as they travel from scene to scene.

Prior to the 1990's, all but the forward motion (in the direction of the track) of a car of a dark ride was controlled by mechanical cams or a similar mechanism—if any such rotational motion was even provided. An example of such a system was employed at the Haunted Mansion attraction at Disneyland, a chain-linked vehicle (CLV) system wherein all the ride system vehicles are linked together to form a continuous chain that all run at the same velocity and are powered by propulsive motor systems permanently mounted to the track. These systems employed mechanical cam rails embedded within or adjacent the track to activate cam followers on the car to rotate the viewing portion or seat at appropriate locations. While these systems proved to be extremely reliable, the cost and complexity of such mechanical cam systems is high. In addition, and perhaps more importantly, once implemented, alteration of such mechanical systems requires extensive replacement or refurbishment of mechanical parts—likely the fabrication and installation of a new rail the entire length of the track. Further, the replacement of just a portion of the rail could result in significant jolts to the patrons. Consequently, the flexibility desired in design of various scenes and sequences in the amusement park ride or positioning of displays in an exhibit was severely limited. Still further, rotation of the seat or viewing portion of the car about a second or third axis required a second or third cam and corresponding rail, multiplying the cost and complexity. Finally, these mechanical cam systems further suffered from the inability to rotate through a full 360 degrees or more.

U.S. Pat. No. 5,527,221 ("the '221 patent") issued to Eduard Feuer and Ronald Brown in 1996 represented a significant improvement over these mechanical cam systems. The invention of the '221 patent replaced the mechanical cam system of Haunted Mansion with an electric motor controlled by a PLC or similar logic device. The PLC of the '221 patent receives signals from sensor activators placed along a track, and sends corresponding signals to an electric motor which rotates the seating portion of the ride vehicle. The '221 patent, however, did not teach a system ideal for simulating movement, for example flight, nor did that system allow for more than the simplest movement in the yaw and pitch directions, and no movement in the roll direction.

A number of simulators have also developed, including several flight simulators, and been employed in amusement park attractions. The Soaring ride at Disney's California Adventure theme park is illustrative of these flight simulators.

Patrons are seated in a theater like configuration, with a large screen in front of them. Video footage, presumably taken from an airplane as it flies over various California landmarks, is displayed on the screen. Near the beginning of the simulation, the patrons are raised from the floor such that their legs are dangling, to further promote the feeling that the patrons are themselves flying. Various flight characteristics, for example diving and turning, are simulated by known combinations of movements of the simulator, mainly by changes in the pitch and roll of the patrons' seating portions, as corresponding video and audio footage is displayed to the patrons.

Another example of a flight simulator employed at an amusement park is the Back to the Future attraction at Universal Studios Florida park. Similar to the Soaring attraction, with the Back to the Future attraction, flight movements are simulated by abrupt changes in the pitch and roll of the simulator (a replica of a Delorean automobile as modified in the 1980s movie "Back to the Future"), timed to correspond with video and audio footage displayed to the patrons. The Back to the Future vehicles are supported from underneath, resulting in undesired moving sensations as described in U.S. Pat. Nos. 6,592,374 B1 and 7,033,177 B2. The simulators of the Soaring and Back to the Future attractions are generally stationary—they do not move along a track from one scene to another, as with a typical dark ride.

There also exist dark ride attractions with an overhead track. The Peter Pan attraction at Disneyland and the ET attraction at Universal Studios Hollywood are the most notable examples of dark ride attractions with vehicles that traverse an overhead track. The ride systems for these attractions are fairly simple—they have no ability to impart rotational movements in the yaw, pitch or roll directions to simulate movement or direct a patron's viewpoint toward desired scenery. Rather, the ride vehicles' only motion is forward relative to the overhead track.

There also exist dark ride attractions that simulate flight with a floor-mounted track. The Harry Potter and the Forbidden Journey attraction at Universal Studios Islands of Adventure in Florida and the Cosmic Adventure attraction at the Taipei Astronomical Museum both use systems that traverse a conventional track affixed to the floor. These ride systems are a bit more complex in that they have the ability to impart rotational movements in the yaw, pitch and sometimes roll directions to simulate movement or direct a patron's viewpoint toward desired scenery. However, the center of rotation for each of these vehicles is primarily located beneath the passengers, resulting in undesired moving sensations as described in U.S. Pat. Nos. 6,592,374 B1 and 7,033,177 B2.

There exists a need for a dark ride vehicle system that provides for simulation of movement (e.g. flight) that also allows for the effective presentation of scenery in all locations relative to the patrons, and eliminates the moving sensations that exist in vehicles wherein the center of rotation is beneath the passengers. The present invention, the preferred embodiment of which is described herein, meets this need, and further provides the capability for unlimited rotation control for the patron viewing seats and allows great flexibility in original design and modification of the rotation and simulation profiles.

SUMMARY OF THE INVENTION

The present invention provides a system for patron movement, wherein the passenger compartment of each vehicle of the system is inverted—hanging from an overhead track. Each vehicle is propelled along the track by a pinch wheel drive system onboard each vehicle, capable of rapid acceleration and braking, or an offboard CLV drive system that is simpler to control, less expensive and can accommodate a high patron capacity.

The yaw rotation of each vehicle is controlled by an electric motor, which in turn is controlled by an onboard controller—a PLC, computer or the like. Each ride vehicle also includes a motion base disposed between the yaw turntable, also controlled by an onboard controller via a slip ring, capable of changing the pitch and roll of the passenger compartment and simulating various movements, such as those that would be experienced in flight.

Each onboard controller receives information from one or more sensors identifying various information concerning the corresponding ride vehicle. For example, one sensor communicates the yaw angle of the passenger compartment; one or more sensors indicate the pitch and roll angles of the passenger compartment or the extension of each of the actuators of the motion base; and one sensor sends an appropriate signal to the onboard controller indicating that a sensor activator disposed on or near the track has been passed.

The system also employs a central controller. The central controller is primarily devoted to the overall control of the system, and is tended to by an operator. For example, the central controller includes an emergency stop, activated both manually by the operator and automatically if any dangerous condition is communicated to the central controller by one of the ride vehicles or any sensor positioned along the track.

DETAILED DESCRIPTION OF THE PREFERRED EMBODIMENT OF THE INVENTION

Figure 1:
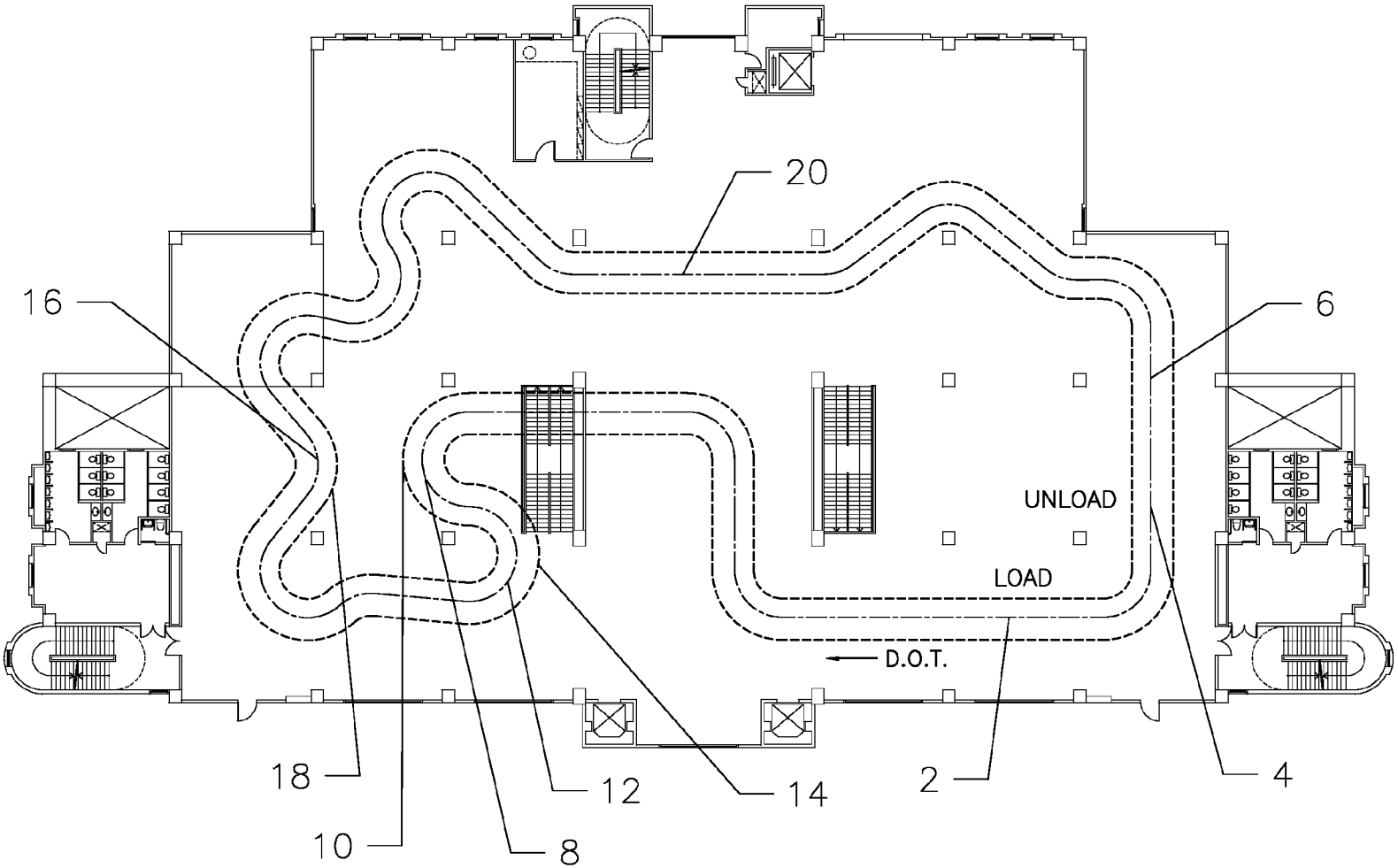
FIG. 1 is a schematic overview of the layout of an attraction consistent with the present invention.

As depicted in FIG. 1, patrons board the ride vehicles at loading platform 2. Preferably in close proximity to loading platform 2 but out of view of loading platform 2, patrons exit the ride vehicles at unloading platform 4. An overhead track 6 is provided to guide the ride vehicles' travel. The overhead track 6 is preferably a circuit, as depicted, to allow the quick loading and unloading of patrons.

While the preferred system includes an overhead track 6 of a conventional steel construction, it should be understood by those skilled in the art that an overhead track of any sort may be employed, as long as the ride vehicles can be suspended from above. For example, the present invention may employ a cable type track system suspended from the ceiling above the ride vehicles, or a guide wire embedded above .the ride vehicles.

The overhead track 6 of the preferred embodiment is multidimensional—i.e. the ride vehicles travel in more than one direction, not just a straight line. By including curves in overhead track 6, the attraction designer can keep particular scenery, effects, and other items of interest out of view of the patrons until their ride vehicle enters a particular zone. This allows the attraction designer to more effectively tell a story through the attraction, with the scenes or events of the story being communicated to the patrons sequentially at each consecutive curve. For example, with the particular layout depicted in FIG. 1, the attraction could locate scenery adjacent to the outer edge 10 of curve 8, and also locate scenery adjacent to the outer edge 14 of curve 12. As the ride vehicles travel through curve 8, the seating portions of those ride vehicles are oriented in the direction of the scenery adjacent to the outer edge 10 of curve 8. Then, as the ride vehicles travel through curve 12, the seating portions of those ride vehicles are rotated in the yaw direction and perhaps otherwise oriented in the pitch and/or roll directions as well, so as to orient the patrons to optimize their viewing of the scenery adjacent to the outer edge 14 of curve 12. The attraction designer can also locate scenery at the outer edge 18 of curve 16, despite its close proximity to the outer edge 10 of curve 8, and still prevent the patrons from viewing that scenery until their ride vehicle reaches curve 16, even if another ride vehicle is traversing curve 16 while said patrons' ride vehicle is traversing curve 8, by erecting a wall, screen or other visual barrier between the outer edge 10 of curve 8 and the outer edge 18 of curve 16.

Being multidimensional, the overhead track 6 may also change elevation. A profile low to the facility floor could allow for loading and unloading, while a higher profile could allow for the vehicles to travel over and above scenery or props. The track may also cross over itself using various elevations, allowing for additional length and placement of scenery at various levels and at angles that would otherwise not be available.

It may also be desirable to include straight portions of overhead track 6, such as straight portion 20 depicted in FIG. 1. The ride vehicles of the preferred embodiment of the present invention are capable of rapid acceleration, in part due to the pinch wheel mechanism that allows the ride vehicles to engage overhead track 6 as discussed below. Such rapid acceleration is best suited to straight portions of overhead track 6. Alternatively, an offboard CLV drive system may be employed, as discussed below. While a CLV drive system does not allow the same kind of rapid acceleration and braking that can be accomplished with the pinch wheel mechanism, it is simpler, less expensive, easier to maintain, and allows a higher ride capacity.

Figure 2:
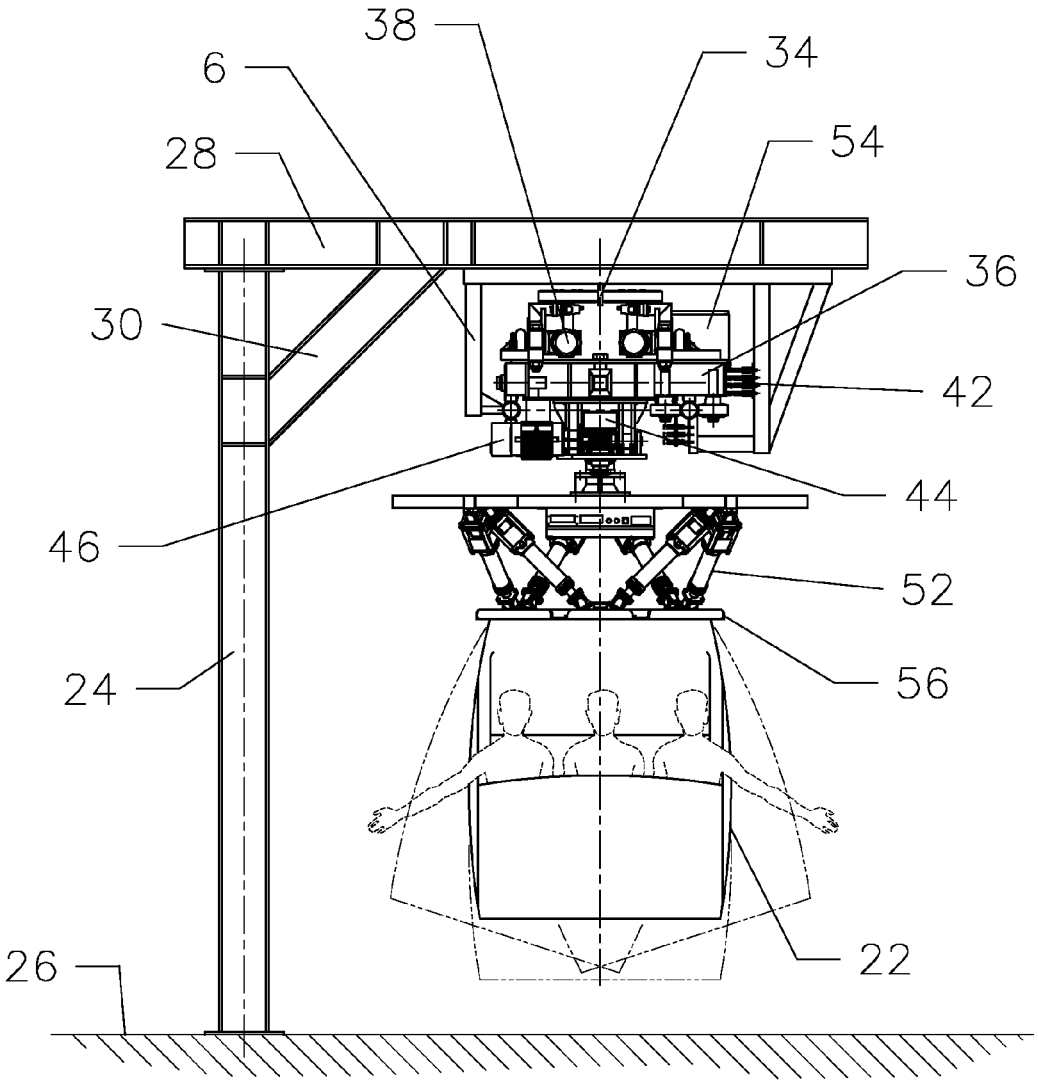
FIG. 2 is a schematic view in the direction of travel of the preferred configuration of the track and components of a ride vehicle consistent with the preferred embodiment of the present invention.
Figure 3:
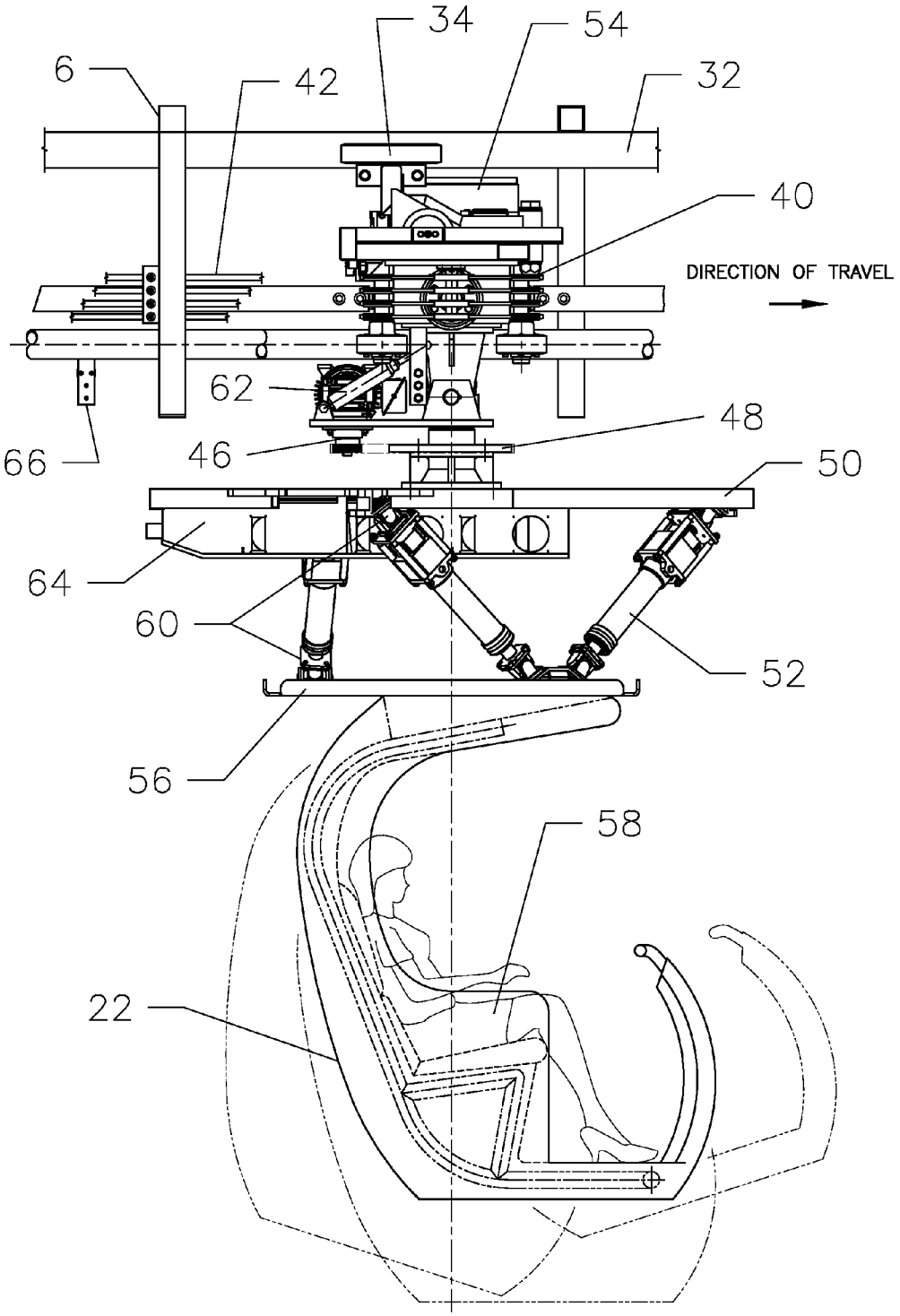
FIG. 3 is a schematic detailed side view of the preferred configuration of the track and components thereon, as well as the components of a ride vehicle consistent with the preferred embodiment of the present invention.

Turning now to FIGS. 2 and 3, schematically showing an exemplary ride vehicle 22 of the preferred embodiment of the present invention engaging overhead track 6, the preferred embodiment of the present invention is further described.

Overhead track 6 is supported by track support 24. Track support 24 is affixed to facility floor 26 at one end and track cantilever 28 at the other end. To provide additional support for track cantilever 28, cross member 30 is also provided, affixed to track support 24 at one end and track cantilever 28 at the opposite end. Track support 24, track cantilever 28 and cross member 30 are all steel I-beams, however those skilled in the art will recognize that track support 24, track cantilever 28 and cross member 30 may be a different material or cross-sectional shape, as long as they are of sufficient strength to support the loads they may encounter in operation of the present invention.

Overhead track 6 is preferably a truss-structure, similar to a rotated C-beam—essentially a hollow beam with a square cross section, with an open channel in one side, preferably oriented towards the bottom. This allows items such as sensor activators, discussed below, to be located securely within the confines of overhead track 6, and provides for an effective guide to ride vehicle 22 as it travels along the rails on either side of the opening in the overhead track 6. Overhead track 6 is supported by, and engaged with, track cantilever 28.

Overhead track 6 also preferably includes a fin 32 to engage the pinch wheel acceleration and braking system 34. The pinch wheel acceleration and braking system 34 includes a set of counter-rotating pinch wheels which compress fin 32 by means of one or more springs or other known mechanism. Preferably, air springs are utilized for this function so that the force with which the springs compress the fin 32 can be adjusted without replacing the springs. The pinch wheels of the pinch wheel acceleration and braking system 34 are driven by one or more drive motors 38. The pinch wheel acceleration and braking system 34 allows greater acceleration and deceleration than is obtainable with more conventional systems, such as one or more drive wheels resting on a steel rail. Traction between such drive wheels and the surface on which they roll is dependent on the weight of the ride vehicle. While increasing the weight of a vehicle may increase the traction between its drive wheels and the surface on which they roll, the increased weight of the ride vehicle actually diminishes the acceleration of the ride vehicle for a given force, and makes braking more difficult. In contrast, the traction of pinch wheels is oriented 90° perpendicular to the vehicle support load, and essentially remains unaffected and thus does not vary much between individual empty and full ride vehicles. The pinch force traction can be increased by providing stronger springs, or adjusting the compression of the preferred air springs, to more tightly squeeze a fin like that provided in the overhead track 6 of the preferred embodiment of the present invention. While employing stronger springs may increase the weight of the ride vehicle 22 a small amount, this small increase in weight has almost no impact on the acceleration and braking capabilities of ride vehicle 22. The greater acceleration and deceleration afforded by utilizing the pinch wheel acceleration and braking system 34 is particularly important in simulation rides—one of the purposes of the present invention. Further, the lower weight facilitated by the pinch wheel system is particularly important with vehicles suspended from an overhead track to avoid unacceptable deflection of the overhead track.

If rapid acceleration and braking are not a concern, it may be desirable to utilize a CLV drive system, which incorporates one or more track-mounted drive motors 38 that propel the vehicles through a straight portion of the track 6. The fin 32 is then mounted onto the tow or trailing bar that interconnects adjacent ride vehicles together. The CLV drive system certainly has disadvantages compared to the pinch wheel drive system discussed above—for example, it is not capable of rapid acceleration or braking, and it does not allow each ride vehicle to have a speed different from each other. However, the track-propelled CLV drive system is simpler to control, less expensive, easier to maintain, and permits a higher capacity of patrons in a given time.

Immediately below the pinch wheel acceleration and braking system 34 and fin 32 is the vehicle bogie 36. The vehicle bogie 36 includes a bus bar interface 40 for drawing electrical power from electrically charged bus bar 42 as the ride vehicle 22 traverses the overhead track 6. The bus bar 42 and bus bar interface 40 allow the electrical components on the ride vehicle—e.g. sensor, rotation motor 46 and motion base actuators 52—to function without having any energy source such as a battery onboard the ride vehicle 22. Vehicle bogie 36 also includes a rotation motor 46. Rotation motor 46 is engaged with pulley 48 by a belt, chain or other suitable mechanism, such that rotation motor can cause pulley 48 to rotate. Pulley 48 is engaged with and above the center of turntable 50. By means of rotation motor 46, pulley 48 and turntable 50, ride vehicle 22 is able to rotate in the yaw direction. Because turntable 50 is always level in the roll direction regardless of the orientation of the ride vehicle 22 with respect to the roll direction, rotation of the turntable 50 by rotation motor 46 and pulley 48 equates to the absolute yaw position of the ride vehicle 22. This makes programming of the vehicle orientation profile much easier for the attraction design team, and also allows the yaw position of the ride vehicle to be dynamically controlled with a precision and reliability not obtainable in systems where the motion base is disposed between the bogie and the turntable, such as with the ride vehicles of the Spiderman attraction at Universal Studios Islands of Adventure in Orlando, Fla. Indeed, the precision and reliability of the controlled dynamic orientation of the ride vehicles of attractions like Universal Studios' Spiderman attraction, in which three-dimensional images are projected to interact with the patrons, is particularly important, as even a small error in the yaw orientation of the patrons can ruin the experience of the three-dimensional projections. The pulley and turntable mechanism, having a belt or chain that goes around the outside of the turntable, is also more desirable than the pinion gear system employed on the Spiderman attraction at Universal Studios Islands of Adventure, because the pulley and turntable mechanism allows more accurate orientation and less wear on the turntable.

It should be understood that it may be desirable to have track cantilever 28 not parallel to the facility floor 26, particularly in order to achieve absolute roll or pitch angles (depending on the vehicle yaw orientation at the time) in excess of what the motion base actuators 52 (discussed below) can achieve alone—for example to simulate a sharp turn in flight, or to direct the patron's attention to the floor below or the ceiling above. In that instance, the rotation of the turntable 50 does not translate into just movement in the absolute yaw direction. However, the rake or bank angle of the track relative to level is a fairly constant and known quantity compared to the pitch and roll orientations caused by the motion base actuators 52 (discussed below). Therefore, the advantages of placing the turntable 50 between vehicle bogie 36 and motion base actuators 52 are still achieved even if the rake and/or bank angle of the track is not level or parallel with the facility floor 26.

Below the turntable 50, is the motion base. Motion base includes six motion base actuators 52. Each of the actuators is affixed to turntable 50 on one end, and passenger canopy 56 on the other end. Through the extension and retraction of the motion base actuators 52, the patron portion 58 of ride vehicle 22 can be oriented in the roll and pitch directions, as well as heave (up and down) and some limited yaw. The motion base actuators depicted in FIG. 2 are operated in pairs of two actuators affixed to universal joints 60 on the passenger canopy 56 and alternately on turntable 50. Accordingly, there are three joints on the passenger canopy 56, preferably spaced equidistant from one another, and three joints on turntable 50, also preferably spaced equidistant from one another and alternately placed from those on the passenger canopy 56. While a 6 degree of freedom ("6 DOF") motion base is depicted in FIG. 2, it should be understood by those skilled in the art that other motion base configurations, such as a 3 DOF motion base, resulting in the elimination of the heave and limited yaw motions, may be employed in accordance with the present invention to achieve the same advantages of the present invention described herein.

A sway dampener 62 is also provided, disposed between the overhead track 6 and the turntable 50. The dampener 62 is not used to actively change the pitch of the patron portion 58 of ride vehicle 22, but can prevent the ride vehicle from rocking in the pitch direction caused by acceleration or deceleration of the vehicle in the direction of travel.

The dampener ensures that the turntable is always level in the pitch direction regardless of the orientation of the ride vehicle 22 with respect to the pitch direction and regardless to the slope of the track. Rotation of turntable 50 by rotation motor 46 and pulley 48 therefore equates to the absolute yaw position of the ride vehicle 22. This makes programming of the vehicle orientation profile much easier for the attraction design team, and also allows the yaw position of the ride vehicle to be dynamically controlled with a precision and reliability not obtainable in systems where the motion base is disposed between the bogie and the turntable, Alternatively, a pitch actuator may be employed rather than a sway dampener. By extending or retracting pitch actuator 62, the pitch (and/or roll—depending on the yaw orientation of turntable 50) of patron portion 58 can be changed in addition to the range of motion achievable by extension and contraction of the motion base actuators 52. In this manner, the patrons' viewpoint can be directed to desired scenery above or below the patron portion 58. The pitch actuator 62 may be used to maintain the motion base and turntable in a level state when the ride vehicle is traveling on a slope.

Both the pitch actuator 62 and the rotation motor 46, are commanded by an onboard controller 54, preferably disposed, as shown, above vehicle bogie 36. Accordingly, each vehicle includes such an onboard controller, and the major operation functions of the pitch actuator 62 and the rotation motor 46 are determined entirely by hardware that is on the respective vehicle.

Onboard controller 54 receives signals from a variety of sensors, which allow the onboard controller to retrieve information regarding the location, orientation, and otherwise the state of the particular ride vehicle on which the onboard controller resides. For example, the onboard controller receives a signal: 1) from a pitch actuator sensor, indicating the extension length of the pitch actuator 62; 2) from a yaw sensor, indicating the yaw position of the turntable 50; and 3) from an onboard sensor that is activated as it passes by one or more sensor activators 66 disposed at fixed locations along the track 6, indicating where the ride vehicle is along the track 6. In response to these signals, and perhaps other information communicated to it, onboard controller 54 commands the pitch actuator 62, the rotation motor 46, and the drive motors 38, as appropriate. Those skilled in the art will recognize that the sensors and sensor activators described herein can be of a variety of types, e.g. encoder, RFID, magnetic, infrared or light. By both receiving and sending signals related to the yaw and pitch of the turntable 50, onboard controller 54 allows a feedback loop for controlling the yaw and pitch of the turntable 50.

Similarly, each ride vehicle includes a motion base controller 64, which both receives signals from sensors indicating the extension length of each motion base actuator 52, and sends signals to cause the motion base actuators 52 to extend or retract. By both receiving and sending signals related to the extension length of the motion base actuators 52, motion base controller 64 allows a feedback loop for controlling the motion base actuators 52.

Inside bogie 36, just above turntable 50, is slip ring assembly 44, an electrical rotatable coupling. Slip ring assembly 44 comprises multiple circuit slip rings that carry electrical power and control signals between onboard controller 54 and motion base controller 64.

The onboard controller 54 of each ride vehicle maintains communication with a central controller as well. The central controller is not responsible for the constant control of the movement of each ride vehicle or the details of the orientation of each ride vehicle. However, the central controller may communicate important safety information to and from the onboard controller—for example, communicating an E-stop to shut down the ride vehicles. The central controller also receives data from the onboard controller 54, such that the central controller has information relevant to the overall operation and safety of the attraction. Further an operator may command certain functions of the both the ride vehicles 22 and the show scenery and/or projections of the attraction through the central controller, such as pause, stop, or restart.

While FIGS. 2 and 3 depict a ride vehicle 22 with a floor, it should be recognized that it may be advantageous to eliminate that floor and restrain the patrons in the patron portion 58, such that the patrons' legs are dangling. This configuration adds to the simulation of flight.

Figure 4:
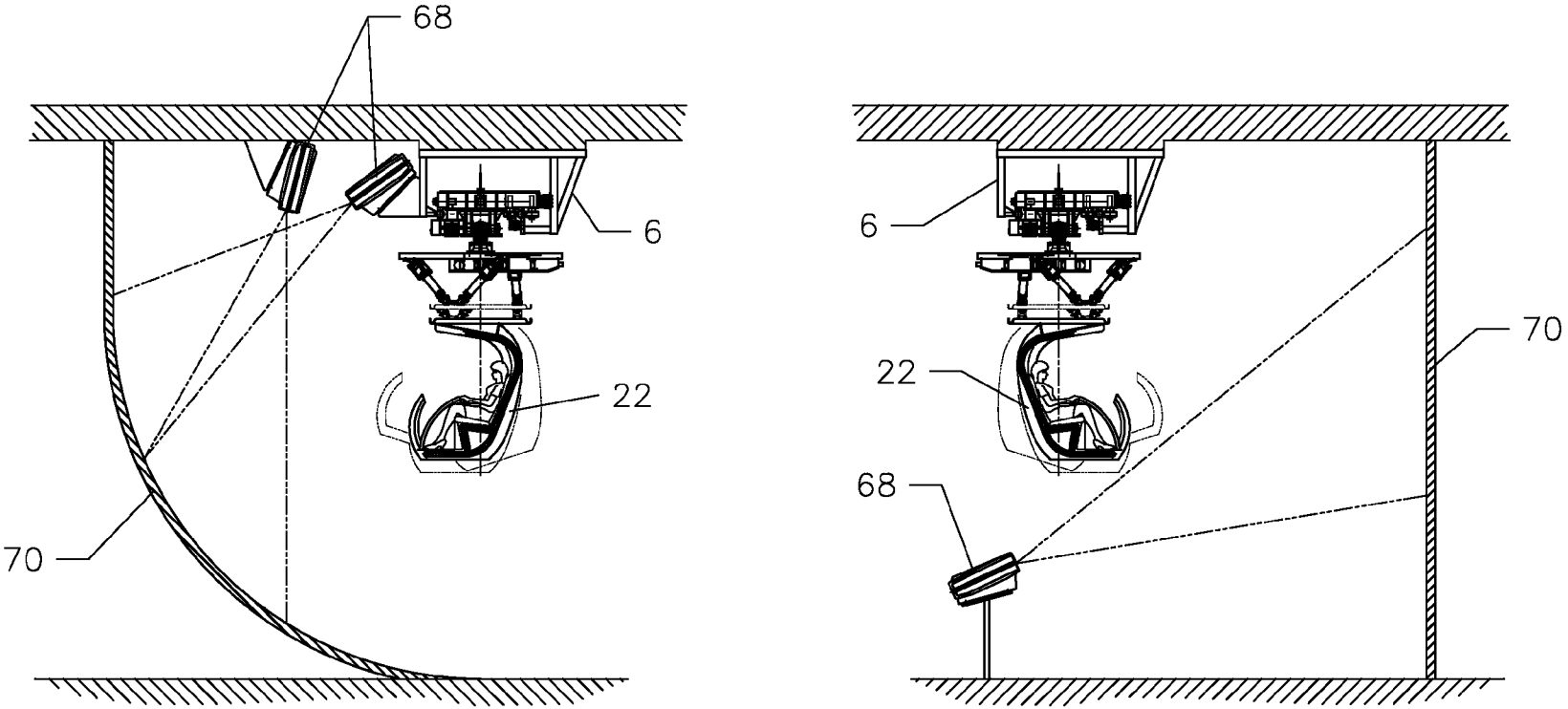
FIG. 4 is a schematic elevation view of the preferred configuration of the track and components thereon, as well as the relative interface of the ride system with a large-scale projection theater, consistent with the preferred embodiment of the present invention.

Turning to FIG. 4, some of the advantages of having vehicles in a dark ride attraction traverse an overhead track 6 as opposed to a conventional track on the facility floor 26,are shown. First, patrons can walk on the facility floor directly underneath the overhead track without fear of being struck by a ride vehicle. This allows the facility within which the dark ride attraction is housed to be significantly smaller, and also allows staff to manipulate or repair the scenery of the dark ride attraction at a time when the attraction is operating. Further, projectors can be located below the ride vehicles, out of the view of the patrons, to project two-dimensional or three-dimensional images on flat or curved screens located to the side of the track 6. Having the eye level of the patrons elevated significantly above the facility floor 26 also allows for larger scenery or images, particularly three-dimensional images, to be displayed to the patrons. Further, and perhaps most importantly, scenery can be displayed, for example on a curved screen, below the patrons. This is particularly useful for simulating flight, as the ground or other things that would be below an object in flight can be displayed below the patrons as it would appear in flight. Also, the center of rotations for pitch and roll are located above the passengers, eliminating any undesired moving sensations, As each ride vehicle passes by a screen 70 or physical scenery located to the side of the track 6, the patron portion 58 of each ride vehicle 22 is rotated to direct the patrons' viewpoint toward the desired screen 70 or physical scenery. Because the ride vehicle 22 may be moving as the physical scenery or projected image is being displayed, the orientation of the patron portion 58 must be maintained toward that scenery or image by continuously adjusting the yaw, and perhaps the pitch, of the turntable. This is accomplished, as discussed above, using the pitch actuator 62, the rotation motor 46 and the pulley 48.

One or more scene sensors may be disposed along the track 6 for detecting the passage of each ride vehicle 22. Each scene sensor communicates with the central controller which, in response to receiving a signal from a scene sensor, commands the beginning and/or end of a scenery effect—for example: the projection of a two or three dimensional motion picture image; the movement of animated physical scenery; or the playing of audio material.

It is understood that many modifications and variations may be devised given the above description of the principles of the invention and a preferred embodiment of the invention.

It is intended that all such modifications and variations be considered within the spirit and scope of this invention, as defined by the following claims.

The invention claimed is:

1. A system for patron movement and entertainment comprising:

a track;

at least one vehicle capable of carrying at least one patron in a passenger portion and moving along the track, said vehicle engaged with the track and disposed below the track;

a motion base, including at least one actuator, located between the track and the passenger portion of the at least one vehicle, capable of changing the orientation of the passenger portion in at least one rotational direction; and a turntable disposed between the track and the passenger portion capable of rotating the passenger portion independent of the motion base.

2. The system for patron movement and entertainment of claim 1 further comprising:

a drive system comprising at least one pinch wheel and at least one drive motor.

3. The system for patron movement and entertainment of claim 1 further comprising:

A programmable controller onboard the at least one vehicle, the controller capable of receiving signals from at least one sensor and sending commands to at least one motor or actuator.

4. The system for patron movement and entertainment of claim 3 wherein the at least one sensor receives signals from a sensor activator at a fixed location along the track.

5. The system for patron movement and entertainment of claim 4 wherein the at least one motor or actuator is capable of dynamically orienting the passenger portion such that the patron's viewpoint is directed at a desired location and maintained toward that location as the vehicle moves along the track.

6. The system for patron movement and entertainment of claim 3 wherein the at least one sensor receives signals indicative of the yaw orientation of the passenger portion.

7. The system for patron movement and entertainment of claim 3 wherein the at least one sensor receives signals indicative of the state of extension of at least one actuator.

8. The system for patron movement and entertainment of claim 1 wherein the turntable is disposed between the track and the motion base.

9. The system for patron movement and entertainment of claim 8 wherein the at least one motor or actuator is capable of dynamically orienting the passenger portion such that the patron's viewpoint is directed at a desired location and maintained toward that location as the vehicle moves along the track.

10. The system for patron movement and entertainment of claim 1 further comprising an actuator capable of changing the orientation of the turntable in the pitch direction.

11. The system for patron movement and entertainment of claim 1 further comprising at least one sensor disposed along the track for communicating to an offboard controller the location of at least one ride vehicle.

12. The system for patron movement and entertainment of claim 1 further comprising at least one projector for projecting an image in the view of the patron at a location not onboard the vehicle.

13. The system for patron movement and entertainment of claim 12 wherein the image is a three-dimensional image.

14. The system for patron movement and entertainment of claim 12 wherein the projector is controlled by an offboard controller.

15. The system for patron movement and entertainment of claim 12 wherein the at least one vehicle travels above at least a portion of a projected image.

16. The system for patron movement and entertainment of claim 12 wherein the at least one motor or actuator is capable of dynamically orienting the passenger portion such that the patron's viewpoint is directed at a desired location and maintained toward that location as the vehicle moves along the track.

17. The system for patron movement and entertainment of claim 1 wherein the at least one motor or actuator is capable of dynamically orienting the passenger portion such that the patron's viewpoint is directed at a desired location and maintained toward that location as the vehicle moves along the track.

18. The system for patron movement and entertainment of claim 1 wherein the track is circuitous.

19. A system for patron movement and entertainment comprising:

a track;

at least one vehicle capable of carrying at least one patron in a passenger portion and moving along the track, said vehicle engaged with the track and disposed below the track;

a motion base, including at least one actuator, located between the track and the passenger portion of the at least one vehicle, capable of changing the orientation of the passenger portion in at least one rotational direction: and a turntable disposed between the track and the passenger portion, wherein the turntable is capable of continuous 360 degree rotation.

20. A system for patron movement and entertainment comprising:

a track;

at least one vehicle capable of carrying at least one patron in a passenger portion and moving along the track, said vehicle engaged with the track and disposed below the track;

a motion base, including at least one actuator, located between the track and the passenger portion of the at least one vehicle, capable of changing the orientation of the passenger portion in at least one rotational direction; and a bus bar for providing electrical power to components onboard the at least one vehicle.

21. The system for patron movement and entertainment of claim 20 further comprising a turntable disposed between the track and the passenger portion capable of rotating the passenger portion independent of the motion base.

22. A method for moving and entertaining patrons in a passenger portion of a vehicle disposed below a track from which it is suspended comprising the steps of:

controlling the pitch and roll orientation of at least one patron;

controlling the yaw orientation of the at least one patron by rotating a turntable disposed between the track and the passenger portion; and controlling the longitudinal position of the at least one patron along said track.

23. The method of claim 22 further comprising the step of:

projecting an image onto a screen; and wherein the yaw, pitch and roll orientation of said at least one patron is controlled so as to orient said at least one patron toward said projected image.

* * * * *